US012129618B2

(12) United States Patent
Odziomek

(10) Patent No.: US 12,129,618 B2
(45) Date of Patent: Oct. 29, 2024

(54) WIRE NETTING, A PROCESS AND A DEVICE FOR MANUFACTURING THE WIRE NETTING

(71) Applicant: Ryszard Odziomek, Cracow (PL)

(72) Inventor: Ryszard Odziomek, Cracow (PL)

( * ) Notice: Subject to any disclaimer, the term of this patent is extended or adjusted under 35 U.S.C. 154(b) by 230 days.

(21) Appl. No.: 17/743,107

(22) Filed: May 12, 2022

(65) Prior Publication Data

US 2022/0267981 A1 Aug. 25, 2022

Related U.S. Application Data

(60) Division of application No. 17/122,416, filed on Dec. 15, 2020, now abandoned, which is a continuation of (Continued)

(30) Foreign Application Priority Data

Jun. 15, 2018 (PL) ..... 425949

(51) Int. Cl.
*E02D 17/20* (2006.01)
*B21F 27/00* (2006.01)

(Continued)

(52) U.S. Cl.
CPC ..... *E02D 17/202* (2013.01); *B21F 27/02* (2013.01); *E01F 7/045* (2013.01); *E02B 3/124* (2013.01);

(Continued)

(58) Field of Classification Search
CPC ..... B21F 27/02; B21F 27/06; B21F 27/005; B21F 27/00; E02D 17/202;

(Continued)

(56) References Cited

U.S. PATENT DOCUMENTS 1,310,966 A * 7/1919 Riviere ..... B21F 27/06 140/6
1,401,557 A * 12/1921 Riviere ..... B21F 27/06 140/6

(Continued)

FOREIGN PATENT DOCUMENTS

BE 865 901 10/1978
BE 865901 A 10/1978

(Continued)

OTHER PUBLICATIONS

International Search report in parent application PCT/IP2019/050812 dated May 28, 2019.

(Continued)

*Primary Examiner* — Mohammed S. Alawadi
(74) *Attorney, Agent, or Firm* — FISHERBROYLES LLP

(57) ABSTRACT

A hexagonal wire netting, a process for manufacturing such a wire netting and a device for manufacturing a hexagonal wire netting, the device including an assembly of tubes for leading the wires of which every other is twisted into a spiral shape, a spindle assembly and a drum receiving the wire netting, the drum being provided with detent elements. Between each tube leading the spirally twisted wire and the cooperating spindle a straightening guide is located having an inlet opening cooperating with the tube and an outlet opening cooperating with the spindle. The detent elements are arranged on the drum in such a way that the produced wire netting has meshes in which the proportion of the width to the length is less than 0.75.

10 Claims, 5 Drawing Sheets

Related U.S. Application Data application No. PCT/IB2019/050812, filed on Feb. 1, 2019.

(51) Int. Cl.

| | |
|---|---|
| ***B21F 27/02*** | (2006.01) |
| ***B21F 27/06*** | (2006.01) |
| ***D04C 1/02*** | (2006.01) |
| ***D04C 1/08*** | (2006.01) |
| ***E01F 7/04*** | (2006.01) |
| ***E02B 3/12*** | (2006.01) |

(52) U.S. Cl.
CPC .. *E02D 2250/00* (2013.01); *E02D 2300/0034* (2013.01)

(58) Field of Classification Search
CPC ..... E02D 2250/00; E02D 2300/0034; E01F 7/045; E02B 3/124
See application file for complete search history.

(56) References Cited

U.S. PATENT DOCUMENTS

| | | | | |
|---|---|---|---|---|
| 1,868,968 | A * | 7/1932 | Rosa | B21F 27/06 140/6 |
| 2,942,630 | A | 6/1960 | Schmid | |
| 3,682,419 | A | 8/1972 | Vanderfaeillie | |
| 4,911,209 | A | 3/1990 | Shannon | |
| 6,279,858 | B1 | 8/2001 | Eicher | |
| 8,070,107 | B2 | 12/2011 | Chen | |
| 8,646,491 | B2 | 2/2014 | Ferraiolo | |
| 2006/0131463 | A1 | 6/2006 | Jun | |
| 2008/0148680 | A1 | 6/2008 | Jaenson | |
| 2011/0114028 | A1 | 5/2011 | Coffin | |
| 2012/0014831 | A1 | 1/2012 | Yamasaki | |
| 2012/0261075 | A1* | 10/2012 | Ferraiolo | B21F 27/06 156/433 |
| 2013/0263975 | A1 | 10/2013 | Yamasaki | |
| 2014/0252173 | A1 | 9/2014 | Suazo Luengo | |
| 2015/0071708 | A1 | 3/2015 | Ferraiolo | |
| 2016/0113253 | A1 | 4/2016 | Cea | |
| 2019/0388957 | A1* | 12/2019 | Ferraiolo | E04C 5/04 |

FOREIGN PATENT DOCUMENTS

| | | | |
|---|---|---|---|
| CL | 32632 | | 5/1981 |
| CN | 202 367 121 | | 8/2012 |
| CN | 202367121 | U1 | 8/2012 |
| CN | 104246076 | A | 12/2014 |
| DE | 102012205484 | A1 | 10/2013 |
| DE | 10 2017 101 754 | B3 | 5/2018 |
| EP | 1219365 | A1 | 7/2002 |
| EP | 1099494 | B1 | 4/2003 |
| EP | 1956145 | A1 | 8/2008 |
| EP | 2235302 | B1 | 8/2011 |
| EP | 2235301 | B1 | 6/2012 |
| EP | 3 056 608 | A1 | 8/2016 |
| FR | 788004 | A | 10/1935 |
| GB | 1250866 | | 10/1971 |
| JP | H07150509 | A | 6/1995 |
| JP | HO7 150509 | | 6/1995 |
| KR | 2007 0036826 | | 4/2007 |
| RU | 2090728 | C1 | 9/1997 |
| RU | 2000105810 | A | 3/2000 |
| RU | 20182025 | A | 5/2002 |
| SU | 1397130 | A1 | 5/1988 |
| WO | 97/04897 | A1 | 2/1997 |
| WO | 99/43894 | A1 | 9/1999 |
| WO | 2015/151025 | | 10/2015 |

OTHER PUBLICATIONS

Third party observations and comments, filed in corresponding patent PCT/IB2019/050812 dated Aug. 31, 2020.
Bertrand et al., "Discrete element method (DEM) numerical modeling of double-twisted hexagonal mesh", Aug. 2008, Canadian Geotechnical Journal 45(8):1104-1117.
European Standard Document EN 10223-3 (Dec. 2013).
Chinese Standard Document GB4357-1989 (English version), "Carbon spring steel wires".
German Standard Document DIN EN 10264-2 (Mar. 2012).

* cited by examiner

State of the art draw. 1

State of the art draw. 2

State of the art draw. 3

State of the art draw. 4

State of the art draw. 5

State of the art draw. 6

WIRE NETTING, A PROCESS AND A DEVICE FOR MANUFACTURING THE WIRE NETTING

The invention concerns a wire netting and a process as well a device for manufacturing the wire netting, for use in particular in protecting roads and communication facilities against breaking of rock chunks off a slope, protecting embankments of water courses against devastation caused by animals (e.g. beavers) and as an embankment stabilization element in case of land movements.

Solutions used for protection of embankments and slopes against rock chunks and land movements are known in the art. Such exemplary known solutions are shown in the state of art FIGS. 1A-1F. For example square wire netting are used. Such nettings, so called fence nettings, are made of interwoven wires bent at an angle (FIG. 1A). The wires used for such netting have low tensile strength. Such nettings have low resistance (limited design scope) resulting from the low tensile strength of the wires used for their manufacture. Application of a substantial force to such netting (25-70 kN depending on the wire diameter) causes breakage of the netting. Further, such nettings tend to unbraid under load in case of a breakage of any individual wire, which is shown by the arrows in FIG. 1A illustrating the state of the art.

Another known solution is a netting having rhomboid-shaped meshes (FIG. 1B). Such nettings are manufactured of high carbon steel wires having high tensile strength but their structure, consisting of interwoven wires bent at an angle, does not guarantee design parameters in case of a breakage of an individual wire either. As in the case of the square mesh netting, a breakage of an individual wire may cause unbraiding of the netting sheet along its whole length/width (see the arrows in FIG. 1B). A broken individual wire may slide out of the neighboring meshes, and depending on how the force is applied, a whole length/width of the sheet may get unbraided.

Hexagonal wire nettings are also used, which do not unbraid upon a breakage of an individual wire. However, these are low carbon steel nettings having low tensile strength of about 550-700 MPa. Such nettings have meshes of 60 mm×80 mm; 80 mm×100 mm; 100 mm×120 mm (FIG. 1C). The use of low carbon steel wires limits the use of such nettings in the case of great loads. Application of a force above 25-70 kN (depending on the wire diameter) causes breakage of the netting. The hexagonal nettings produced up to now have a strength between 25 and 70 kN.

Rope nettings are also known in which rope crossings are connected by clamping. Manufacture of the rope nettings is expensive and their laying on a slope is cumbersome. Due to their substantial weight heavy equipment must be used. The meshes of such nettings are so large that rock chunks of a 10 cm diameter may go through.

Hexagonal wire nettings are also used that are made of low tensile strength wires (550-700 MPa), but reinforced with interwoven high strength ropes spaced by 30-50 cm (FIG. 1D). Such nettings have meshes of 60 mm×80 mm; 80 mm×100 mm; 100 mm×120 mm. However, the reinforcement of this type is only apparent. The high strength is only present where the ropes are interwoven. Between the ropes the netting has low tensile strength (depending on the wire diameter—25-70 kN).

Machines for manufacture of hexagonal wire nettings are well known in the art. An exemplary scheme of such a machine is shown in FIG. 1E. The process for manufacturing a netting in the machine of FIG. 1E starts with bending every other wire forming the netting into a spiral shape which facilitates their braiding into a netting. The wires, of which every other is twisted, are fed by an assembly of tubes to a spindle assembly in which the wires are being braided to form the meshes. From the spindle assembly the woven netting is brought to a receiving drum provided with detent elements, the arrangement of the detent elements defining the shape and dimensions of the formed meshes. One wire supplied from one tube passes through each spindle. Exemplary spindles of a typical machine for manufacture of hexagonal nettings are schematically shown in FIG. 1F. The spindle assembly contains two rows of many half-cylindrical spindles arranged face to face, as shown in FIG. 1F. During the process of braiding the spindles of both rows are translated back and forth so that each spindle is paired in turns with one or other of the two neighboring spindles of the opposite row. Each temporarily formed pair of spindles turns by 540 degrees in alternative directions which results in 1.5 fold braiding of the wires leaving each pair of spindles. After each turn each spindle returns to its former position and move to the neighboring spindles with which they turn again. This way a netting is being gradually woven and then transferred to the drum the detent elements of which impart the hexagonal shape to the meshes.

The problem connected with the known machines described above is that they are only suitable for the manufacture of hexagonal nettings made of low carbon steel wire having the tensile strength in the range of 550-700 MPa. However, a hexagonal netting may not be manufactured of a high carbon wire having a higher tensile strength using the machines of this type. This is due to the fact that such a wire is more brittle and it brakes when the pre-formed spirals pass from the tubes to the spindles (within the spindles the wires pass straight). Also, the arrangement of the detent elements on the receiving drum of a typical machine requires considerably strong bending of the already braided wires on the drum. This is because the netting formed on such a typical machine has meshes the shape of which is close to a square (see FIGS. 1C and 1D) with relatively short sides. Such a shape is not a problem if the netting is made of a soft wire having a relatively low tensile strength, but a high strength wire tends to brake when twisted on such a short length and transferred to the drum. As a consequence, it is practically impossible to produce a hexagonal netting of a steel wire having the tensile strength above 700 MPa.

The aim of the invention was to provide a hexagonal wire netting and a process and device for manufacturing a wire netting that would have tensile strength higher than known wire nettings and a structure preventing unbraiding of the netting in case of damaging of an individual wire.

Another aim of the invention was to provide a wire netting having a structure of a possibly greatest elasticity, so as to enable pre-tensioning of the wire netting mounted on the ground.

The above aims have been attained by the hexagonal wire netting according to the invention, for use in particular in protecting soil embankments, the wire netting being made of steel wires and being characterized in that the wires are braided in at least 1.5 fold braids so as to form meshes in which the proportion of the width to the length is lower than 0.75, the wires being made of high carbon steel having tensile strength in the range of 1500-1900 MPa.

Preferably, the wires are made of a steel having carbon content from 0.71% to 1%.

The wires may be provided with an anti-corrosion coating, preferably a zinc-aluminum coating in the amount of min. 150 g/m$^2$.

Optionally, the wires may be made of stainless steel.

According to the invention also a device is provided for manufacturing a hexagonal wire netting, the device comprising an assembly of tubes for leading the wires of which every other is twisted into a spiral shape, a spindle assembly and a drum receiving the wire netting, the drum being provided with detent elements. Each spindle is adapted to lead one wire passing therethrough and fed by a cooperating tube and to be translated back and forth as well as rotated by 540 degrees alternately with the translations, so that the wires leaving the spindles are braided in at least 1.5 fold braids forming the wire netting to be subsequently received by the drum.

The device according to the invention is characterized in that between each tube leading the spirally twisted wire and a cooperating spindle a straightening guide is located having an inlet opening cooperating with the tube and an outlet opening cooperating with the spindle, and in that said detent elements are arranged on the drum in such a way that the produced wire netting has meshes in which the proportion of the width to the length is less than 0.75.

Preferably, the straightening guide comprises a wall in a shape of truncated cone, the smaller edge of which constitutes a central outlet opening cooperating with the spindle, and the larger edge of which constitutes a central inlet opening cooperating with the outlet of the tube.

The inner side of the wall in a shape of truncated cone is preferably provided with a guiding groove for assisting in the straightening of the wire.

The straightening guide may optionally comprise a hollow cylinder having an inlet edge and an outlet edge, and being provided with an inlet wall in a shape of a truncated cone, the larger edge of which is aligned with the inlet edge of the hollow cylinder and constitutes the inlet opening cooperating with the outlet of the tube, while the smaller edge of which constitutes the inlet opening leading to the hollow cylinder, which is further provided with an outlet wall in a shape of a truncated cone, the larger edge of which constitutes the outlet edge of the hollow cylinder, while the smaller edge of which constitutes the central outlet opening cooperating with the spindle.

Preferably, the inner side of said inlet wall in a shape of a truncated cone is provided with a guiding groove for assisting in the straightening of the wire.

The straightening guide is preferably made of a plastic material.

The process according to the invention for manufacturing a hexagonal wire netting in a device comprising an assembly of tubes leading the wires every other of which is twisted into a spiral shape, a spindle assembly and a drum receiving the wire netting, the drum being provided with detent elements, and each spindle being adapted to lead one wire passing therethrough and fed by a cooperating tube and the spindle being translated back and forth as well as rotated by 540 degrees alternately with the translations, so that the wires leaving the spindles are braided in at least 1.5 fold braids so as to form the wire netting to be subsequently received by the drum.

The process according to the invention is characterized in that the wires made of high carbon steel having tensile strength in the range of 1500-1900 MPa are used, and in that the wires that are spirally twisted in the tubes are being straightened before being fed into the spindles, the produced wire netting having meshes in which the proportion of the width to the length is less than 0.75.

Preferably, the wires made of a steel having carbon content from 0.71% to 1% are used.

The wires may be provided with an anti-corrosion coating, preferably a zinc-aluminum coating in the amount of min. 150 g/m$^2$.

Preferably wires of stainless steel are used.

Exemplary embodiments of the wire netting and the device for the manufacture of the wire netting according to the invention are shown in the drawings in which:

FIGS. 1A, 1B, 1C, 1D, 1E, and 1F show fragments of the wire netting according to the prior art;

Figure 1A:
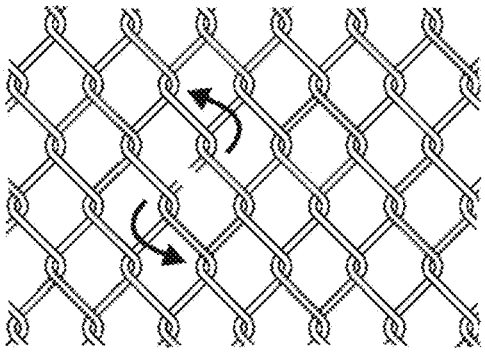
FIG. 1G shows a fragment of the wire netting according to the invention.
Figure 1B:
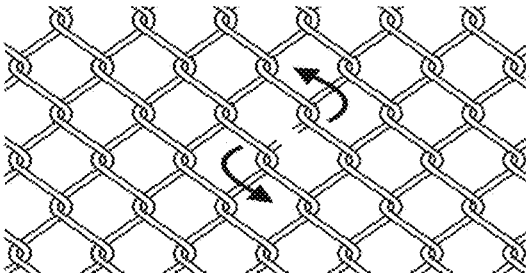
Figure 1C:
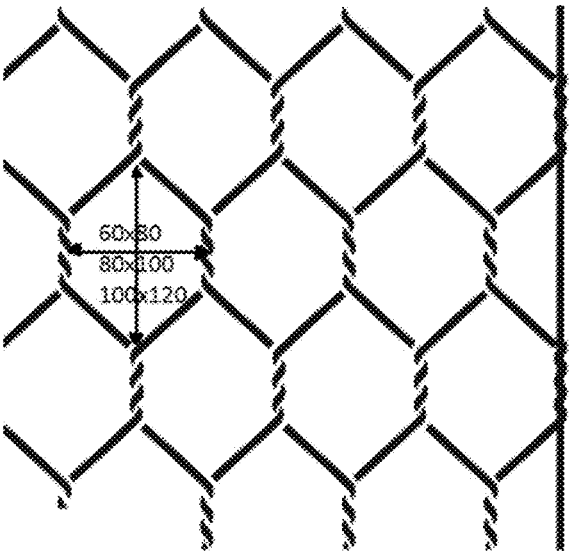
Figure 1D:
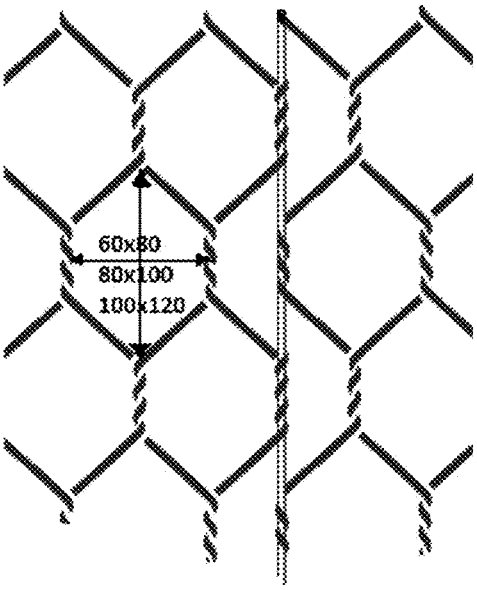
Figure 1E:
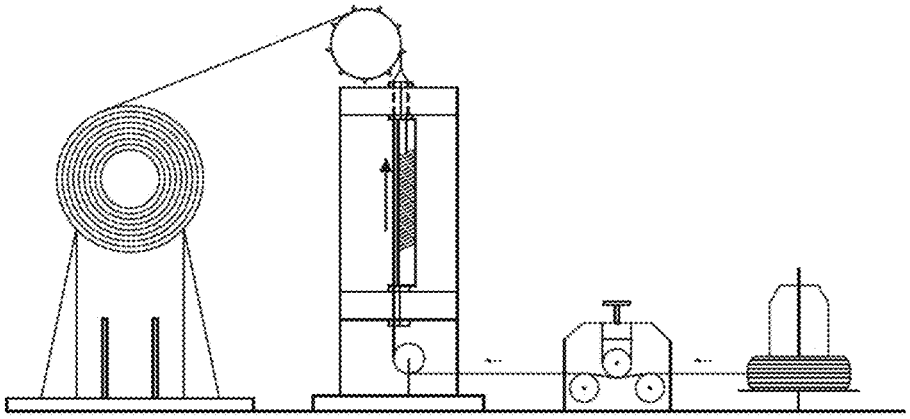
Figure 1F:
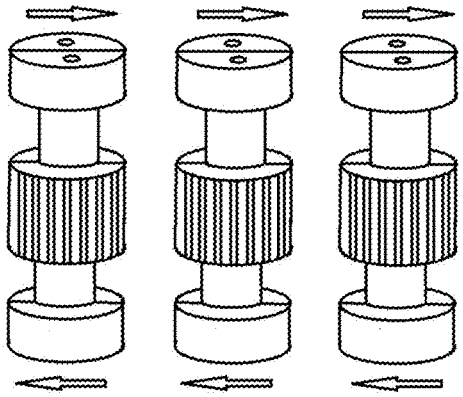
Figure 1G:
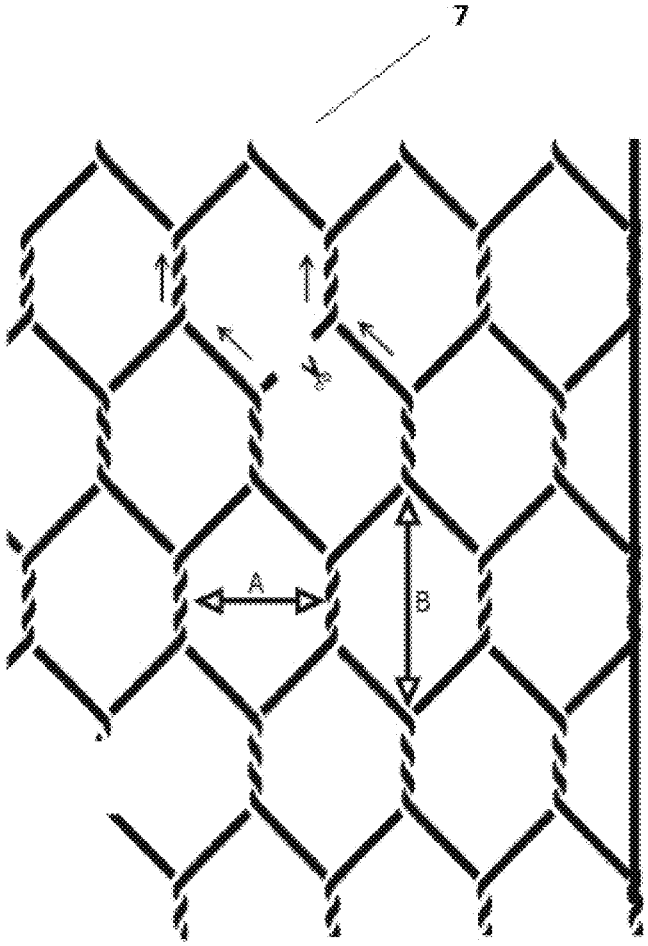

As may be seen in FIG. 1G, showing a fragment of the wire netting 7 according to the invention, each hexagonal mesh of the wire netting 7 has two sides with braids and four sides without the braids. Further, each mesh has six corners: there are four corners where the side with a braid meets the side without it, and two corners (opposite to each other) where two sides without the braids meet. The width A of a mesh is defined here as the distance between the two sides with the braids, and the length B of a mesh is defined as the distance between the two corners where two sides without the braids meet.

The inventors have established that a wire made of high carbon steel having tensile strength in the range of 1500-1900 MPa may be used for manufacturing the hexagonal wire netting 7 with at least 1.5 fold braids provided that the wires have been straightened before being introduced into the spindles and that said wires are not exceedingly bent later on the receiving drum. Therefore, in the meshes of the wire netting 7 according to the invention the proportion of the width A to the length B is less than 0.75. Basing on experiments it has also been established that the most advantageous content of carbon in the steel used for the wire is in the range of 0.71% to 1%, because such a wire is sufficiently resistant and at the same time ductile to enable the manufacture of the wire netting 7 according to the invention. A higher content of carbon would make the wire too brittle while a lower content thereof would make it too ductile and with a too low tensile strength.

A preferable thickness of a wire for the manufacture of the wire netting 7 according to the invention is about 2.0 to about 4.0 mm.

Figure 2:
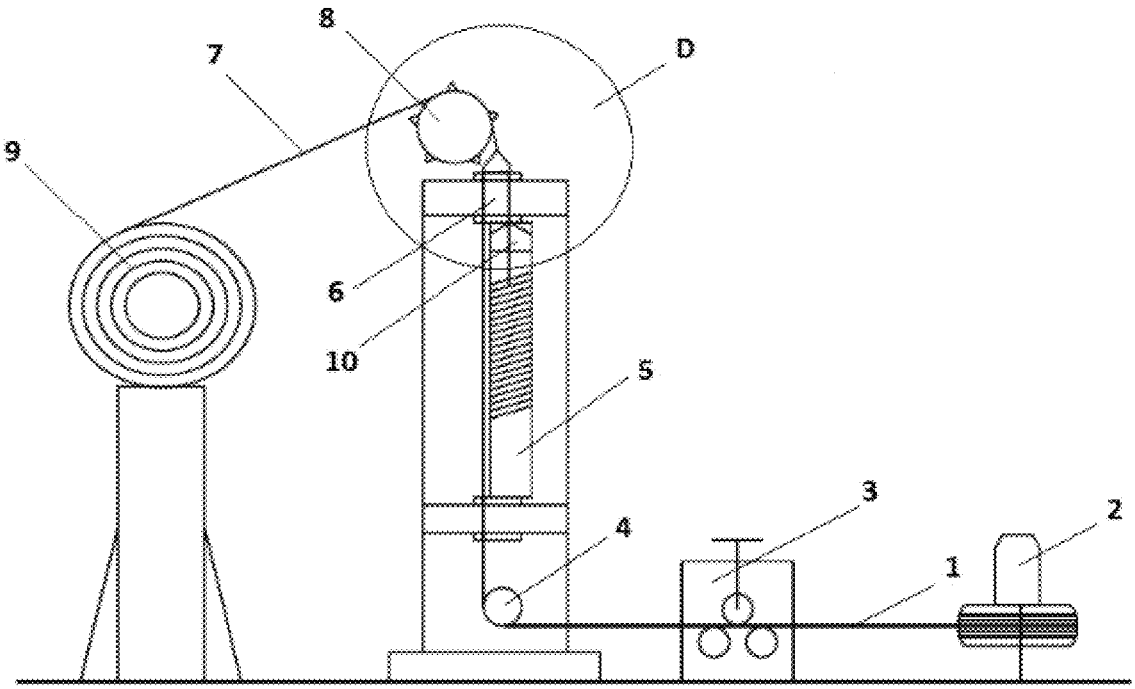
FIG. 2 shows a schematic view of a fragment of the device according to the invention.

FIG. 2 shows a schematic view of a fragment of the device according to the invention.

The wires 1 are brought from delivery stations 2 by means of guiding elements 3 and 4, to a tube assembly 5. The tubes 5 of the tube assembly form a row. In every other tube of the row a wire is being twisted into a spiral shape, i.e., in every other tube the wire remains straight. In FIG. 2, the wire 1 in the tube 5 is being twisted. Downstream of the assembly of the tubes 5 (as shown in FIG. 2 above the tube assembly 5) a spindle assembly 6 is located, so that the wire 1 leaving each tube 5 is passed to a cooperating spindle 6. The neighboring wires are braided with each other by the spindles 6 (the same as in the above-described state of art machine) and from the spindles 6 the ready wire netting 7 is passed to the drum 8 and then wound on a roll 9.

A specific feature of the device according to the invention is that it is provided with wire straightening guides 10. Between each tube 5, in which the wire 1 is being spirally twisted and its cooperating spindle 6, the straightening guide 10 is located.

Figure 3:
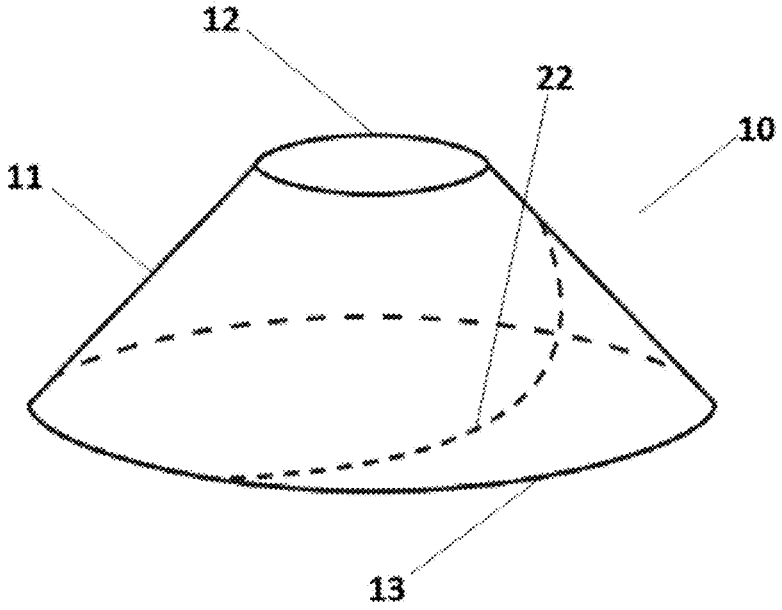
FIG. 3 shows schematically a first embodiment of the straightening guide.

In the first and simplest embodiment shown in FIG. 3, the straightening guide 10 is formed by a wall in the shape of truncated cone 11, the smaller edge of which constitutes a central outlet opening 12 cooperating with the spindle 6, while its larger edge constitutes a central inlet opening 13 cooperating with the outlet of the tube 5.

Figure 4:
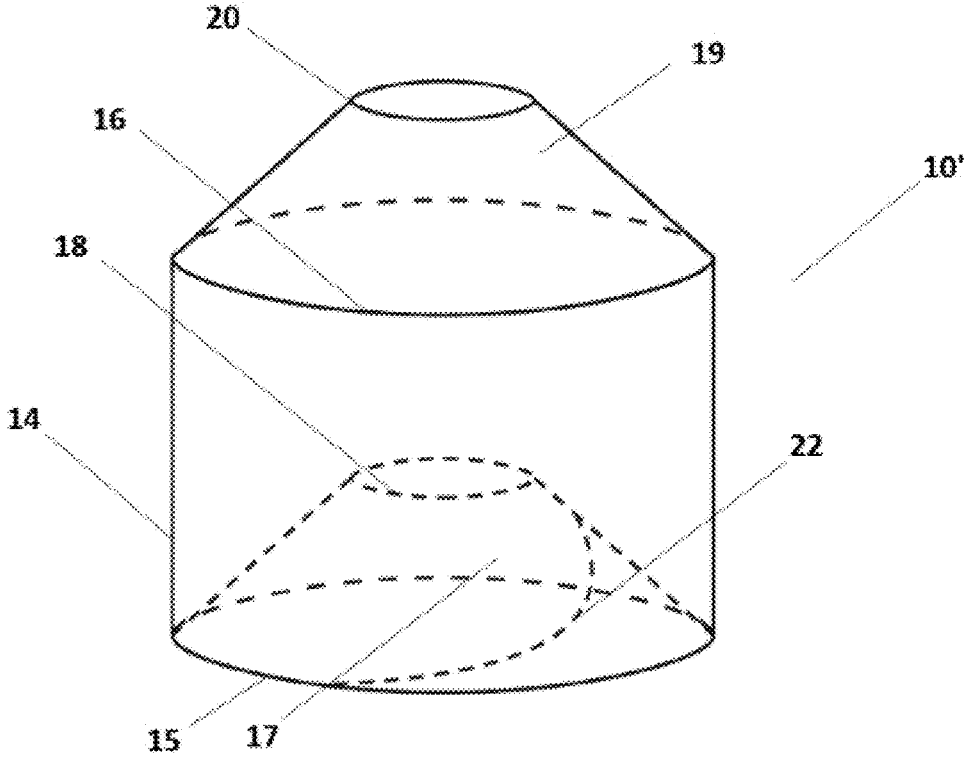
FIG. 4 shows schematically a second embodiment of the straightening guide.

FIG. 4 shows an embodiment in which the straightening guide 10' comprises a hollow cylinder 14 having an inlet edge and an outlet edge, and being provided inside with an inlet wall 17 in the shape of a truncated cone, the larger edge of which is aligned with the inlet edge of the hollow cylinder 14 and constitutes the inlet opening 15 cooperating with the outlet of the tube 5. The smaller edge of the inlet wall 17 constitutes the inlet opening 18 leading to the inside of the hollow cylinder 14. The hollow cylinder 14 is further provided on its outside with an outlet wall 19 in the shape of a truncated cone, the larger edge of which constitutes the outlet edge of the hollow cylinder, while the smaller edge of which constitutes the central outlet opening 20 cooperating with the spindle 6.

The straightening guide 10, 10' is preferably made of a plastic material. In order to facilitate the straightening of the wire 1 passing through the guide 10 or 10', a spiral guiding groove 22 may be located on the internal side of the truncated cone 11 or respectively 17. An exemplary spiral guiding groove 22 is visible as a broken line in FIGS. 3 and 4.

Figure 5:
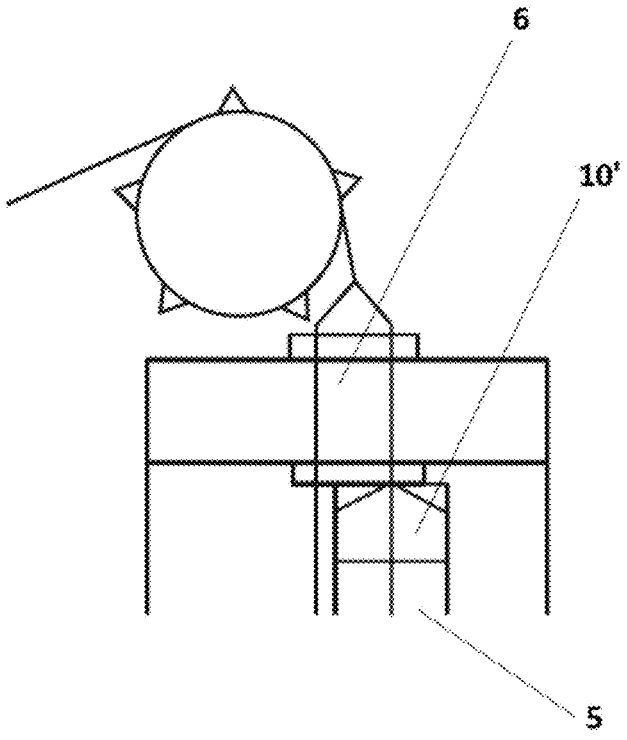
FIG. 5 shows a detailed view of the connection between a tube and a spindle in the device according to the invention.

FIG. 5 shows an enlarged view of a detail D (circled in FIG. 2) of a fragment of the machine between the tube 5 and the spindle 6, where the straightening guide 10' is mounted.

Figure 6:
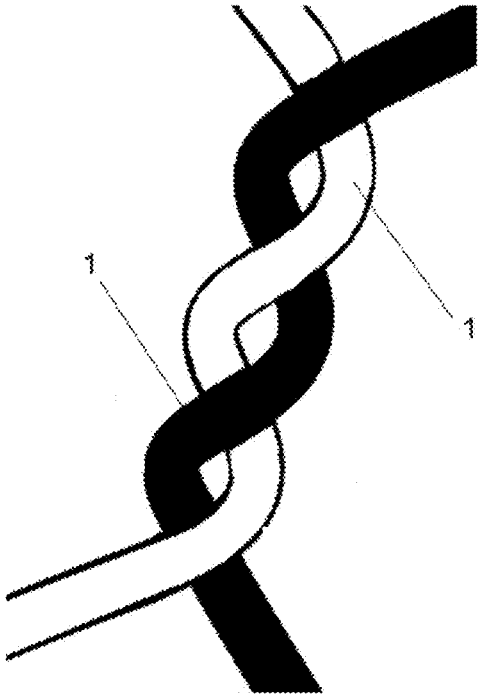
FIG. 6 shows an enlarged view of a braid of two wires in a final wire netting according to the invention

Due to the provision of the straightening guides 10, 10' the twisted wires 1 that are made of a relatively stiff steel having high tensile strength, are being straightened prior to being introduced to the spindles 6. Subsequently, the spindles 6 impose at least 1.5 fold braiding of the neighboring wires with each other. An exemplary braid of two wires 1 is shown in FIG. 6.

Figure 7:
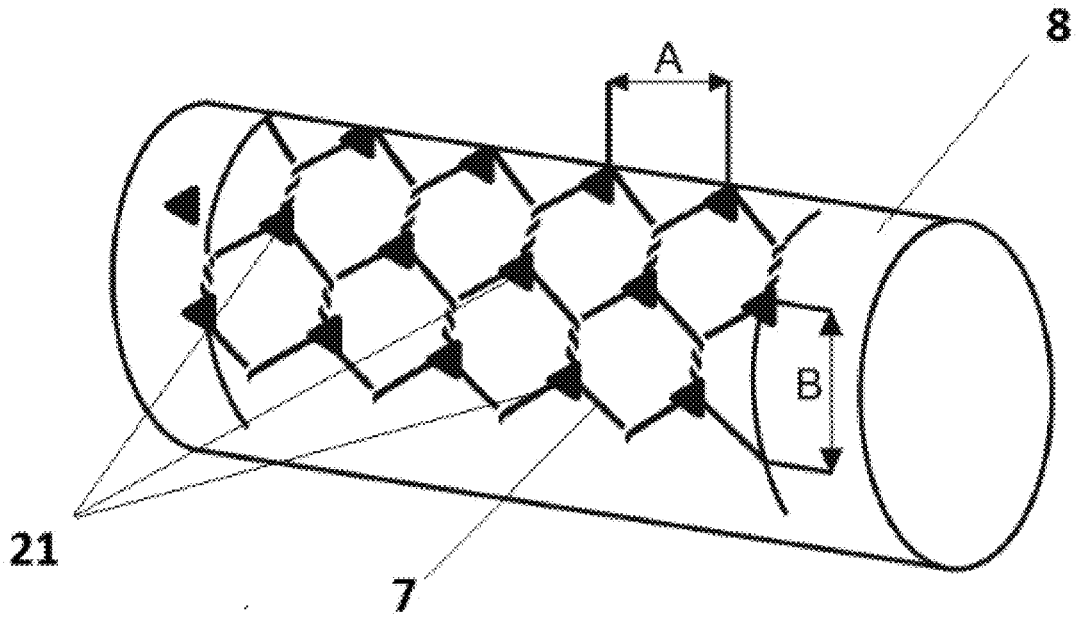
FIG. 7 shows a schematic view of a drum of the device according to the invention.

Another important feature of the invention is the use of the receiving drum 8 shown in FIG. 7, having detent elements 21 arranged in such a way that the produced wire netting 7 is formed with hexagonal meshes in which the proportion of the width A to the length B is less than 0.75.

The use of the specific straightening guides 10, 10' and the special arrangement of the detent elements 21 on the receiving drum 8 results in that the high tensile-strength wire does not brake during the at least 1.5 fold braiding which enables formation of the hexagonal netting.

Thanks to the hexagonal structure and the at least 1.5 fold braiding the wire netting will not unbraid even in case of a breakage of one wire. Upon the breakage of one individual wire (as schematically shown by scissors in FIG. 1G) the forces are transferred by the neighboring wires and the unbraiding of the wire netting is prevented by the neighboring braids because the netting is made of high tensile-strength wires. The edges of a wire netting sheet are provided with border wires or ropes, which are also made of a high tensile-strength steel and ensure an orderly shape of the netting edges.

The wire netting 7 according to the invention may be a component of a system in which conventional plates/washers are used for pressing the mounted wire netting to the slope (not shown).

As the wire netting 7 according to the invention is woven from the high tensile-strength wires, it tends to self-constrain upon braiding of the wires. Consequently, the arising hexagonal structure is elastic and the width of the band of the netting received by the drum is smaller than the maximal possible width of the band when stretched. Such an elastic structure is a sort of an energy absorber and it may be mounted on an embankment base for the purpose of catching rock chunks without the need to use absorbing spring ropes.

An additional advantage of the invention is that the wire netting 7 according to the invention enables continuous protection of large surfaces. On some embankments, the wire netting may be formed of a continuous material on the whole length of the embankment. For example, a rolled wire netting having a length of 30 m is made of continuous 40 m long wires, the 10 m reduction being caused by the hexagonal shape of the meshes. On the other hand, rhomboidal nettings may not be manufactured of the wires longer than about 4 m.

The invention claimed is:

1. A device for manufacturing a hexagonal wire netting, the hexagonal wire netting comprises wires, the device comprising:

a tube assembly comprising tubes for leading the wires, every other tube having wires twisted into a spiral shape forming spirally twisted wires, a spindle assembly comprising spindles, a drum receiving the wire netting, the drum comprising detent elements, each spindle of said spindle assembly being configured to lead one wire passing therethrough and fed by a cooperating tube of the tubes, each of the spindles of said spindle assembly being alternately translated back and forth and rotated by 540 degrees, so that the wires leaving the spindles are braided in at least 1.5 fold braids forming the hexagonal wire netting to be subsequently received by the drum, a straightening guide disposed between each of the every other tube in the tube assembly having the spirally twisted wires and a respective one of the spindles of the spindle assembly, the straightening guide having an inlet opening cooperating with a respective one of the tubes of the tube assembly and an outlet opening cooperating with the respective one of the spindles of the spindle assembly, and wherein said detent elements are arranged on the drum in such a way that the hexagonal wire netting has meshes having a width to length ratio of less than 0.75.

2. The device according to claim 1, wherein the straightening guide comprises a wall in a shape of a truncated cone, the straightening guide having a smaller edge which constitutes a central outlet opening cooperating with the respective one of the spindles of the spindle assembly, and a larger edge which constitutes a central inlet opening cooperating with an outlet of the respective one of the tubes of the tube assembly.

3. The device according to claim 2, further comprising a guiding groove defined in an inner side of the wall in a shape of a truncated cone for assisting in straightening of the wires prior to being introduced into the spindles of the spindle assembly.

4. The device according to claim 1, wherein the straightening guide comprises a hollow cylinder having an inlet edge and an outlet edge, with the straightening guide comprising an inlet wall in a shape of a truncated cone, the straightening guide having a larger edge of which is aligned with the inlet edge of the hollow cylinder and constitutes an inlet opening cooperating with an outlet of the respective one of the tubes of the tube assembly, and a smaller edge which constitutes an inlet opening leading to the hollow cylinder, with the straightening guide further comprising an outlet wall in a shape of a truncated cone, the outlet wall having a larger edge which constitutes an outlet edge of the hollow cylinder, and a smaller edge which constitutes an outlet opening cooperating with the respective one of the spindles of the spindle assembly.

5. The device according to claim 4, wherein an inner side of said inlet wall in a shape of a truncated cone comprises a guiding groove for assisting in straightening of the wires prior to being introduced in the spindles of the spindle assembly.

6. The device according to claim 1, wherein the straightening guide is made of a plastic material.

7. A process for manufacturing a hexagonal wire netting in a device, the wire hexagonal wire netting comprising wires, the device comprising a tube assembly comprising tubes for leading the wires, every other tube having wires twisted into a spiral shape forming spirally twisted wires, a spindle assembly comprising spindles, a drum receiving the wire netting, the drum comprising detent elements, and each of the spindles of the spindle assembly being configured to lead one wire passing therethrough, the one wire being fed by a cooperating tube of the tubes of the tube assembly, the method comprising:

forming the wires using high carbon steel having tensile strength in a range of 1500-1900 MPa, straightening the wires that are spirally twisted in the tubes before feeding them into the spindles of the spindle assembly, and feeding all the wires into the spindles of the spindle assembly, and alternately translating each of the spindles of the spindle assembly back and forth and rotating each of the spindles of the spindle assembly by 540 degrees, so that the wires leaving the spindles are braided in at least 1.5 fold braids so as to form the hexagonal wire netting to be subsequently received by the drum, wherein the hexagonal wire netting comprises meshes having a width to length ratio of less than 0.75.

8. The process according to claim 7, wherein the wires made of steel having carbon content from 0.71% to 1% are used.

9. The process according to claim 7, wherein the wires are provided with an anti-corrosion coating comprising a zinc-aluminum coating in the amount of min. 150 g/m2.

10. The process according to claim 7, wherein the wires of stainless steel are used.

* * * * *